US006945823B2

(12) United States Patent
Lee et al.

(10) Patent No.: US 6,945,823 B2
(45) Date of Patent: Sep. 20, 2005

(54) SERIAL ATA CONNECTOR WITH COMPLIANT CONTACT

(75) Inventors: George Lee, Irvine, CA (US); William E. Spink, Jr., Laguna Niguel, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 75 days.

(21) Appl. No.: 10/632,475

(22) Filed: Aug. 1, 2003

(65) Prior Publication Data

US 2005/0032433 A1 Feb. 10, 2005

(51) Int. Cl.[7] ..... H01R 24/00
(52) U.S. Cl. ..... 439/660; 439/637; 439/65
(58) Field of Search ..... 439/636–637, 439/62–65, 660

(56) References Cited

U.S. PATENT DOCUMENTS 6,139,373 A * 10/2000 Ward et al. ..... 439/733.1
6,648,682 B1 * 11/2003 Wu ..... 439/567
6,746,281 B1 * 6/2004 Zhang ..... 439/637

* cited by examiner

*Primary Examiner*—Truc Nguyen
(74) *Attorney, Agent, or Firm*—Wei Te Chung

(57) ABSTRACT

A Serial Advanced Technology Attachment (SATA) connector (40) for being mounted to a printed circuit board (PCB) (200) includes an insulative housing (70) and a plurality of compliant contacts (80). The housing has a pair of side walls (700), a pair of end walls (701), and a bottom wall (702) which together defining a mating space (703), an L-shaped tongue extending from the bottom wall into the mating space. Each contact having an engaging portion (802) retained in the L-shaped tongue and a press-fit tail (803) vertically extending beyond the bottom wall adapted for being mounted to the PCB. The housing further comprises a pair of pegs (706) is integrally formed on the bottom wall of the housing adapted for guiding the press-fit tails mounted into the PCB without damaged.

4 Claims, 6 Drawing Sheets

SERIAL ATA CONNECTOR WITH COMPLIANT CONTACT

CROSS-REFERENCES TO RELATED APPLICATION

The subject matter of this patent application is pertinent to contemporaneously filed U.S. Patent Applications entitled "SERIAL ATA CONNECTOR WITH RIGHT ANGLE CONTACT" and entitled "SERIAL ATA CABLE ASSEMBLY", all invented by the same inventor and assigned to the same assignee as this patent application.

BACKGROUND OF THE INVENTION

1. Field of the Invention

The present invention generally relates to a Serial Advanced Technology Attachment (SATA) connector, and more particularly to a SATA connector having compliant contacts.

2. Description of Related Art

Currently, most computers have a storage device called a hard drive. A hard drive is connected to the computer by way of an interface, usually a controller card, a cable, and some software protocols. One type of hard drive interface used today is an integrated drive electronics (IDE) interface. This is also known as an advanced technology attachment (ATA) interface. ATA is the actual interface specification for the IDE standard. The current IDE/ATA standard is a parallel interface whereby multiple bits of data are transmitted at one time across the interface simultaneously during each transfer. A parallel interface allows for high throughput, however, as the frequency of the interface is increased, signaling problems and interference between signals become common.

Serial Advanced Technology Attachment (SATA) is an interface specification that abandons the parallel concept in favor of a serial interface where only one bit is transferred at a time. This allows the interface to operate at higher speeds without the problems associated with a parallel interface at higher speeds. As computer processor performance has increased, so have the read/write data rates of hard disk drive heads and media. Serial ATA eliminates bottlenecks that occur in parallel AT interfaces.

Currently, SATA connectors are only single position seven pin connectors. Today, not only are processor speeds increasing, but the amount of space that a computer fits into is shrinking. Therefore, the motherboards or printed circuit boards (PCB) that hold the electronics and other devices for a computer have limited space. In a computer which may contain multiple hard drives, multiple SATA connectors and SATA cable assemblies may need to reside on the printed circuit board and occupy the space of the computer. This takes up considerable space, depending on the number of hard disk drives and associated SATA connectors.

Therefore, there is a need for integrating overall SATA connector interfaces into one interface that saves computer space and simplifies the assembly and manufacturing of the SATA connector.

SUMMARY OF THE INVENTION

An object of the present invention is to provide a SATA connector for saving computer space.

Another object of the present invention is to provide a SATA connector for achieving a more reliable high speed signals and low speed signals transmission.

In order to achieve the objects set forth, a SATA connector in accordance with the present invention for being mounted to a printed circuit board (PCB) comprises an insulative housing and a plurality of compliant contacts. The insulative housing has a pair of side walls, a pair of end walls and a bottom wall which together define a mating space, an L-shaped tongue extends from the bottom wall and into the mating space. A pair of pegs is integrally formed on the bottom wall of the housing. Each compliant contact has an engaging portion retained in the L-shaped tongue and a press-fit tail vertically extending beyond the bottom wall adapted for being mounted to the PCB.

Other objects, advantages and novel features of the invention will become more apparent from the following detailed description when taken in conjunction with the accompanying drawings.

DETAILED DESCRIPTION OF THE INVENTION

Figure 1:
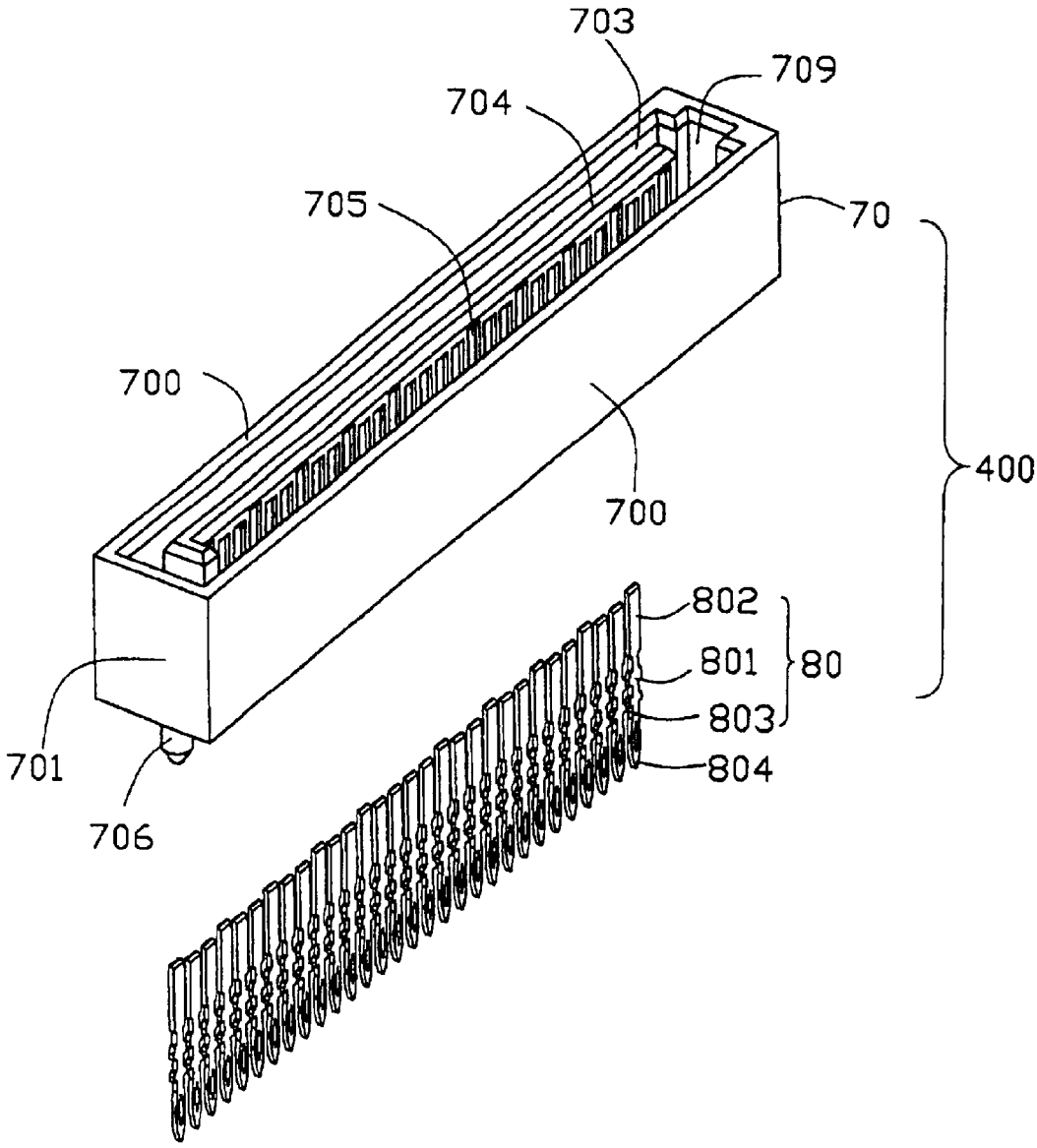
FIG. 1 is an exploded, perspective view of a SATA connector with compliant contacts in accordance with the present invention.
Figure 2:
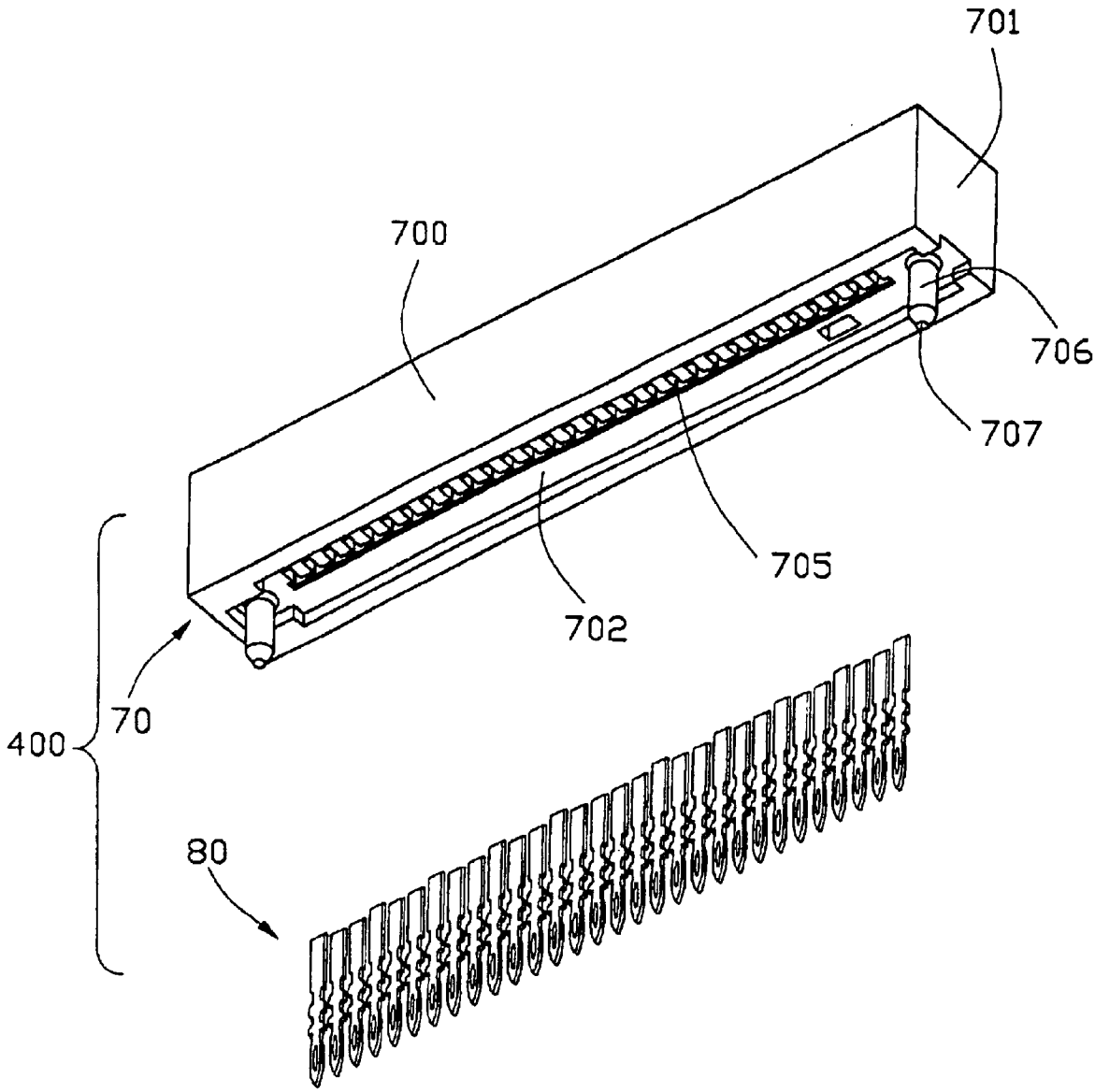
FIG. 2 is a view similar to FIG. 1, but taken from a rear aspect.
Figure 3:
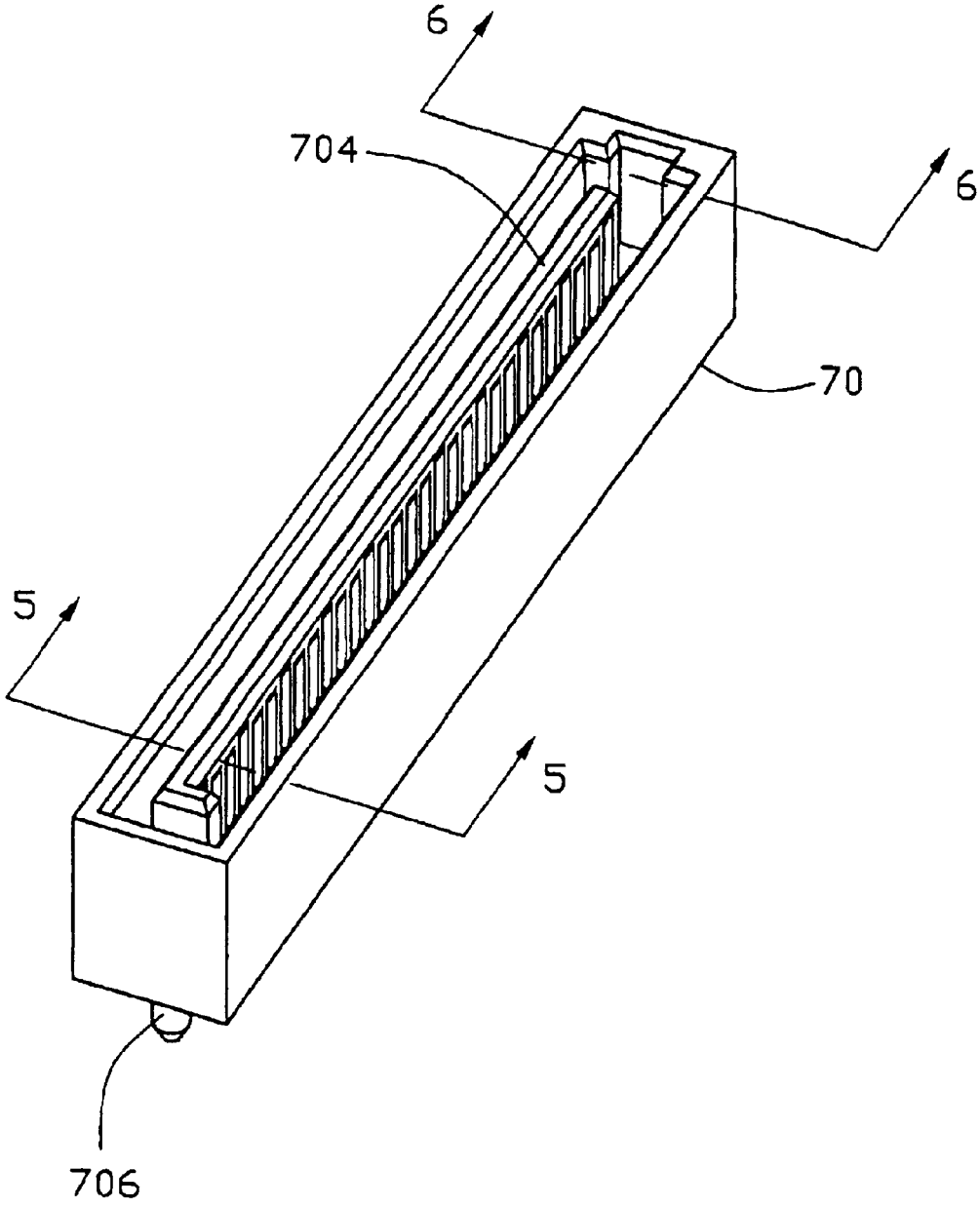
FIG. 3 is an assembled perspective view of the SATA connector of FIG. 1.
Figure 4:
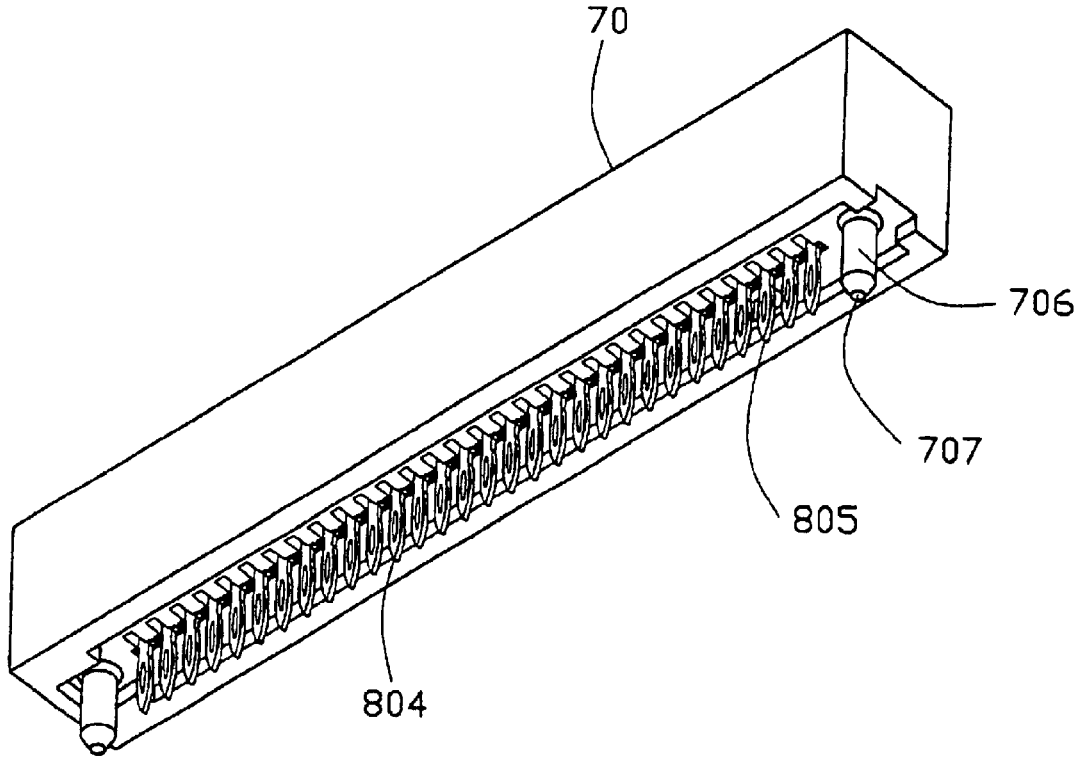
FIG. 4 is a view similar to FIG. 3, but taken from a rear aspect.
Figure 5:
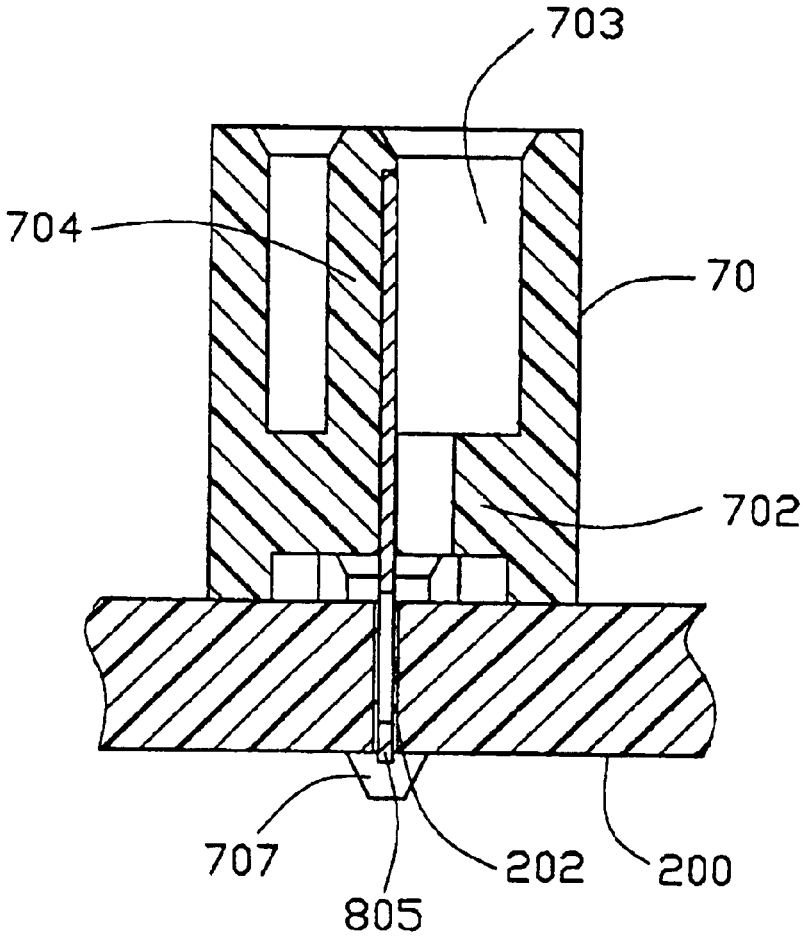
FIG. 5 is a cross-sectional view taken along line 5—5 of FIG. 3 showing the SATA connector mounted to a printed circuit board (PCB)
Figure 6:
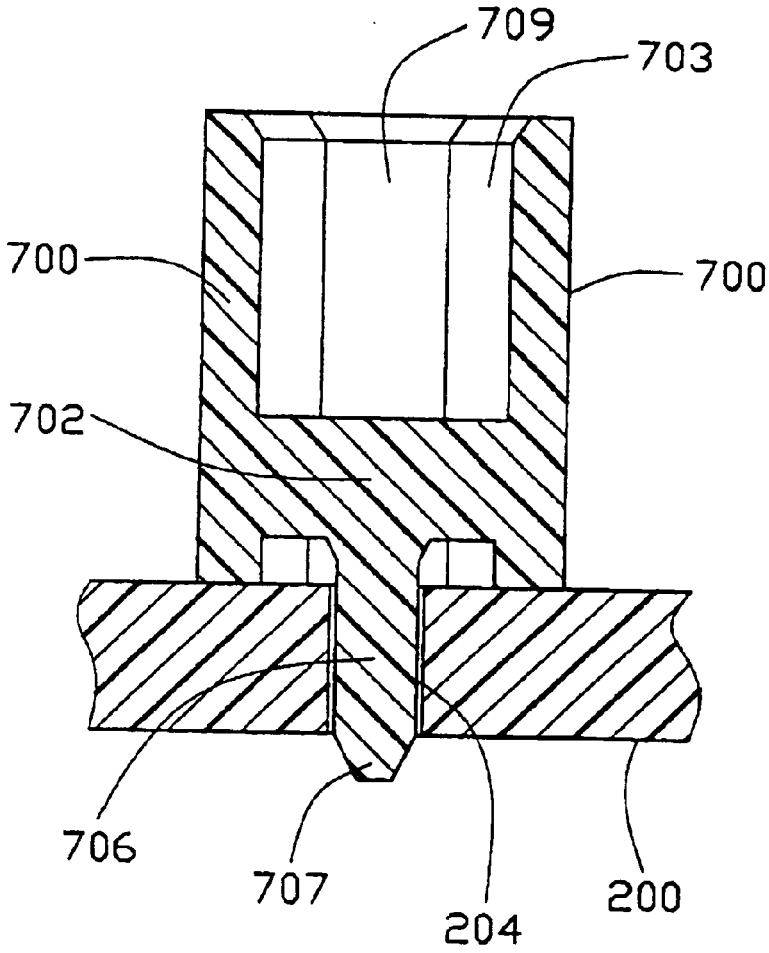
FIG. 6 is a cross-sectional view taken along line 6—6 of FIG. 3 showing the SATA connector mounted to the PCB.

Referring to FIGS. 1 and 2, a SATA connector 400 comprises an insulative housing 70, a plurality of compliant contacts 80 arranged in a line.

The insulative housing 70 comprises a pair of side walls 700, a pair of end walls 701, and a bottom wall 702 which together defines a mating space 703. An L-shaped tongue 704 extends from the bottom wall 702 and into the mating space 703. A plurality of passageways 705 is defined in a side face of the L-shaped tongue 704 and extending through the bottom wall 702, a slot 709 is defined in a end wall 701 and communicating with the mating space 703. A pair of pegs 706 is integrally formed on the bottom wall 702 and adjacent to the pair of end walls 701. The plurality of passageways 705 locates between the pair of the pegs 706.

The plurality of contacts 80 separately transmit high speed signals and low speed signals. Each compliant contact 80 comprises a securing portion 801 at a middle thereof, an engaging portion 802 extending upwardly from the securing portion 801, and a press-fit tail 803 extending downwardly from the securing portion 801. The press-fit tail 803 has a needle eye 804 at a center thereof. The plurality of compliant contacts 80 separately transmits high speed signals, grounding signals, and low speed signals or power.

Referring to FIGS. 3–6, in assembly, the contacts 80 are assembled into the housing 70 with each securing portion 801 assembled into a pair of side walls of the passageway 705, each engaging portion 802 received into the passageway 705 and exposed in the mating space 703, and the press-fit tail 803 extending beyond the bottom wall 702 of the housing 70. The plurality of contacts 80 arranged in a line locates between the pair of the pegs 706. The peg has a lowest end 707 at a bottom thereof, the press-fit tail has a tip 805 at a bottom thereof, and the lowest end 707 is lower than the tip 805 of the press-fit tail 803.

When the SATA connector is mounted to a Printed Circuit Board (PCB) 200, the pair of pegs 706 aligns with a pair of first holes 204 of the PCB 200 and the lowest ends 707 of the pair of pegs 706 first enter into the first holes 204, at the same time, the tips 805 of the contacts 80 align with the second holes 202 of the PCB 200. Then, the press-fit tails 804 of the contacts 80 follow into the corresponding second holes 202 of the PCB 200 and are firmly retained into the second holes 202 to electrically connect with circuit of the PCB 200. A diameter of the first hole 204 of the PCB 200 is larger than a diameter of the peg 706 of the housing 700, thus there is a clearance between the peg 706 and the first hole 204.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly;

a printed circuit board;

a Serial Advance Technology Attachment (SATA) connector mounted unto the printed circuit board, and defining an insulative housing with two opposite end walls and two opposite side walls commonly defining a mating space therein with an L-shape tongue extending in said mating space, said L-shaped tongue including a longer section extending along a longitudinal direction of the housing and a shorter section extending along a transverse direction perpendicular to said longitudinal direction, a slot formed in one of said pair of end walls spaced farther from the a shorter section;

an underside of the housing defining a standoff periphery so as to have an undersuface of the housing spatially lifted from the printed circuit board; and a pair of pegs integrally downwardly from the undersurface of the housing around two opposite end walls; wherein a cutout is formed in said standoff periphery around one of said end walls to outwardly expose a root section of the corresponding peg along the longitudinal direction while a root of the other peg is not.

2. The assembly as claimed in claim 1, wherein said cutout and said slot are commonly located around the same one of said pair of end walls.

3. An electrical assembly comprising:

a printed circuit board;

a Serial Advanced Technology Attachment (SATA) connector mounted unto the printed circuit board, and defining an insulative housing with two opposite end walls and two opposite side walls commonly defining a mating space therein with an L-shaped tongue extending in said mating space, said L-shaped tongue including a longer section extending along a longitudinal direction of the housing and a shorter section extending along a transverse direction perpendicular to said longitudinal direction, a slot formed in one of said pair of end walls spaced farther from the a shorter section;

an underside of the housing defining a standoff periphery so as to have an undersurface of the housing spatially lifted from the printed circuit board; and a pair of pegs integrally downwardly from the undersurface of the housing around two opposite end walls; wherein the standoff periphery forms a wider U-shaped portion around one of said pair of end walls for closely protectively surrounding the corresponding one of said pair of pegs while the other peg is relatively farther away from corresponding portion of the standoff periphery.

4. The assembly as claimed in claim 3, wherein said U-shaped portion and the shorted section of the tongue are commonly located around the same one of said pair of end walls.

* * * * *